US011467614B2

(12) United States Patent
Wang et al.

(10) Patent No.: US 11,467,614 B2
(45) Date of Patent: Oct. 11, 2022

(54) VOLTAGE MODE LOW-DROPOUT REGULATOR CIRCUIT WITH REDUCED QUIESCENT CURRENT

(71) Applicant: Apple Inc., Cupertino, CA (US)

(72) Inventors: Ruopeng Wang, San Jose, CA (US); Jay B. Fletcher, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 104 days.

(21) Appl. No.: 17/017,639

(22) Filed: Sep. 10, 2020

(65) Prior Publication Data

US 2022/0075402 A1 Mar. 10, 2022

(51) Int. Cl.
*G05F 1/575* (2006.01)
*G05F 1/565* (2006.01)

(52) U.S. Cl.
CPC ..... *G05F 1/575* (2013.01); *G05F 1/565* (2013.01)

(58) Field of Classification Search
CPC ..... G05F 1/565; G05F 1/575
See application file for complete search history.

(56) References Cited

U.S. PATENT DOCUMENTS 7,313,176 B1 12/2007 Groen
9,543,834 B2 1/2017 Izumoto et al.
9,667,142 B2 5/2017 Kuroiwa et al.
10,248,145 B2 * 4/2019 Ciomaga ..... G05F 1/575
2003/0102851 A1 * 6/2003 Stanescu ..... G05F 1/575 323/280
2017/0255214 A1 * 9/2017 Ho ..... H02M 3/158
2018/0173258 A1 * 6/2018 Singh ..... G05F 1/575

FOREIGN PATENT DOCUMENTS

CN 105242734 A * 1/2016
CN 111221369 A * 6/2020
CN 111338413 A * 6/2020 ..... G05F 1/56

* cited by examiner

*Primary Examiner* — Sisay G Tiku
(74) *Attorney, Agent, or Firm* — Kowert, Hood, Munyon, Rankin & Goetzel, P.C.; Dean M. Munyon

(57) ABSTRACT

A voltage regulator circuit includes a switch device that is coupled between an input power supply and a regulated power supply node. The voltage regulator circuit adjusts a value of a current flowing from the input power supply to the regulated power supply node by modifying a voltage level of a control node coupled to the switch device. A control circuit adjusts the voltage level of the control node using an error signal based on a comparison of the voltage level of the regulated power supply node and a reference voltage. To improve the response time of the voltage regulator circuit to changes in load current, the control circuit additionally sources current to and/or sinks current from the control node based on a voltage level of the control node.

18 Claims, 11 Drawing Sheets

VOLTAGE MODE LOW-DROPOUT REGULATOR CIRCUIT WITH REDUCED QUIESCENT CURRENT

BACKGROUND

Technical Field

Embodiments described herein relate to integrated circuits, and more particularly, to techniques for generating regulated power supply voltages.

Description of the Related Art

Modern computer systems may include multiple circuits blocks designed to perform various functions. For example, such circuit blocks may include processors and processor cores configured to execute software or program instructions. Additionally, the circuit blocks may include memory circuits, mixed-signal or analog circuits, and the like.

In some computer systems, the circuit blocks may be designed to operate at different power supply voltage levels. Power management circuits may be included in such computer systems to generate and monitor varying power supply voltage levels on the power supply nodes for the different circuit blocks.

Power management circuits often include one or more power converter circuits configured to generate regulated voltage levels on respective power supply signals using a voltage level of an input power supply signal. Such regulator circuits may employ different techniques for regulating the voltage level of the power nodes. For example, a power converter may be a switching regulator, a linear regulator, or any suitable combination thereof.

SUMMARY OF THE EMBODIMENTS

Various embodiments for generating a regulated power supply voltage level are disclosed. A voltage regulator circuit that includes a switch device coupled between an input power supply and a regulated power supply node is configured to change, using a voltage level of a control node, a value of a supply current flowing from the input power supply node to the regulated power supply voltage node. A control circuit is configured to generate a feedback signal using a voltage level of the regulated power supply node and compare a voltage level of the feedback signal to a reference voltage level to generate an error signal. The control circuit is further configured to adjust the voltage level of the control node using the error signal and a current flowing through the control node. By adjusting the voltage of the control node in this fashion, the current consumed by the voltage regulator circuit to perform its regulation functions may be reduced, thereby improving the efficiency of the voltage regulator circuit.

BRIEF DESCRIPTION OF THE DRAWINGS

The following detailed description makes reference to the accompanying drawings, which are now briefly described.

DETAILED DESCRIPTION OF EMBODIMENTS

Figure 1:
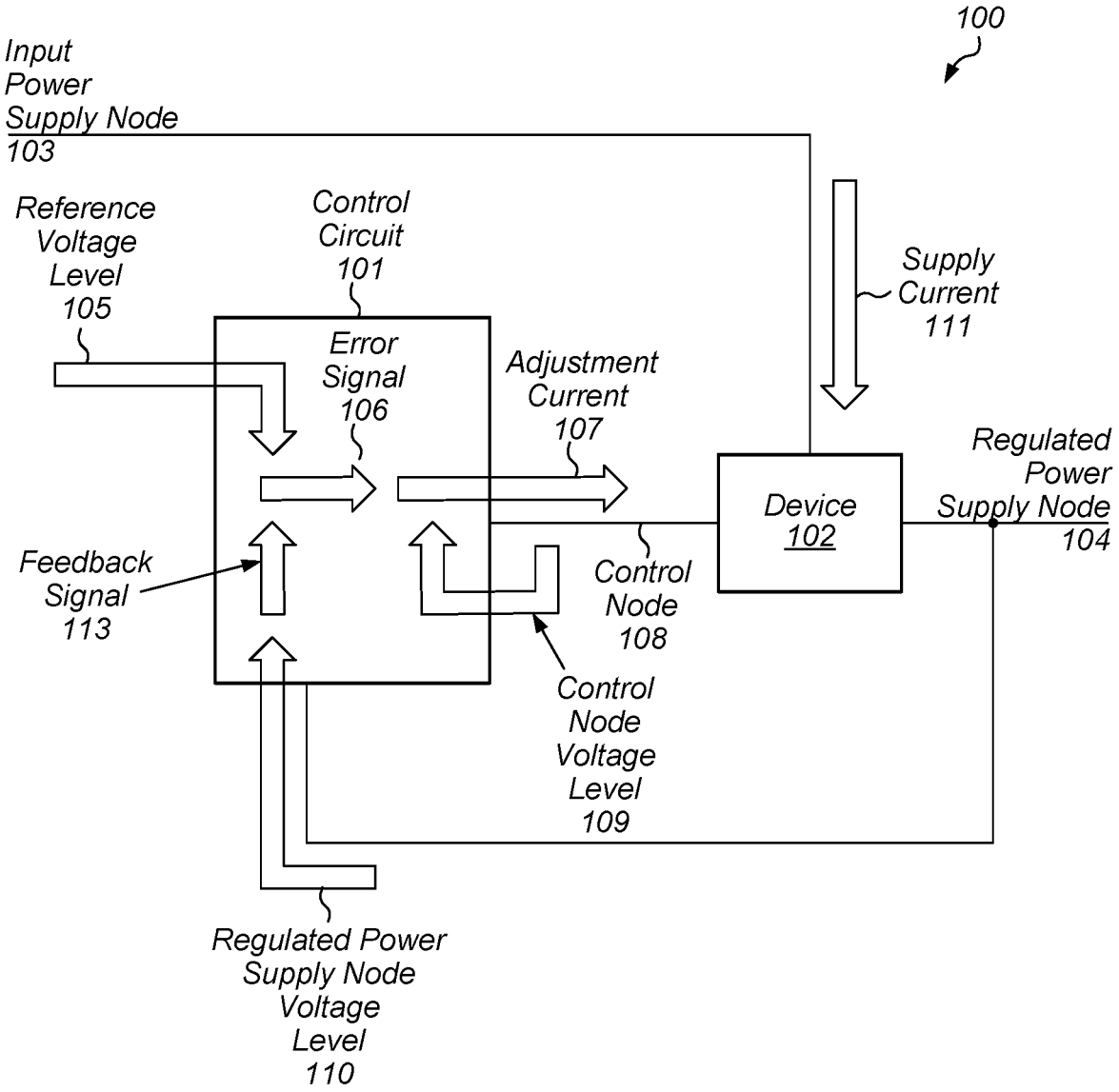
FIG. 1 is a block diagram of an embodiment of a voltage regulator circuit.

Computer systems may include multiple circuit blocks configured to perform specific functions. Such circuit blocks may be fabricated on a common substrate and may employ different power supply voltage levels. Power management units (commonly referred to as "PMUs") may include multiple power converter circuits configured to generate regulated voltage levels for various power supply signals. Such power converter circuits may employ regulator circuits that include both passive circuit elements (e.g., inductors, capacitors, etc.) as well as active circuit elements (e.g., transistors, diodes, etc.). These voltage regulator circuits are designed to keep a voltage constant regardless of a change in the input voltage or the circuit load.

Different types of voltage regulator circuits may be employed based on power requirements of load circuits, available circuit area, and the like. For example, in situations in which switching noise on a regulated power supply node is not tolerable by load circuits, a linear regulator circuit may be selected over a switching regulator. One type of commonly used voltage regulator circuit is a linear regulator circuit, which is typically employed in situations in which switching noise is not desirable. A linear regulator circuit employs a variable conductance (often implemented as a regulation device) between an input power supply node and a regulated power supply node. By adjusting the value of the variable conductance, the voltage level of the regulated power supply node may be maintained at a desired value.

A particular variation of a linear regulator circuit is a low-dropout (LDO) regulator circuit. An LDO regulator circuit can provide regulation on a regulated power supply node even when a voltage level of the regulated power supply node is close to a voltage level of the input power supply node. LDO regulator circuits can employ one of two regulation modes in order to maintain the desired voltage level on the regulated power supply node: voltage mode and current mode. A voltage-mode LDO regulator circuit uses a feedback signal, typically generated by a voltage divider circuit, that is compared to a reference voltage level to generate a control signal, which is used to adjust the impedance between the input power supply node and the regulated power supply node. A current-mode LDO regulator circuit generates a demand current using the feedback signal and the reference voltage level, and then compares the demand current to the current flowing to the load to generate the control signal.

The amount of current used by a regulator circuit to maintain regulation is referred to as "quiescent current," which determines the power consumed by the regulator circuit. In general, higher performance demands (e.g., speed of operation, bandwidth, etc.) may result in higher quiescent currents and power consumption. In many applications, the performance of a circuit is balanced against the quiescent current of the circuit. Since a current-mode LDO regulator circuit senses the load current, its quiescent current increases with load current. In large load current situations, the current-mode LDO regulator circuit's quiescent current can also be large, resulting in undesirable power dissipation.

When the voltage level of the input power supply node is close to the voltage level of the regulated power supply node, a regulator circuit enters what is referred to as the "dropout region." A regulator circuit is often operated in the dropout region when the voltage level of the input power supply node is low, possibly as part of a computer system entering a low-power mode. When a current-mode LDO regulator circuit is operated in the dropout region, its quiescent current can be quite large in order to keep the regulation device's conductance sufficiently high. The high quiescent current results in high power dissipation, which may be problematic with the computer system entering the low-power mode.

Like a current-mode LDO regulator circuit, a voltage-mode LDO regulator circuit that employs a source-follower circuit as a driver can also suffer from a large quiescent current that is a result of biasing the output stage with a large current to reduce its output impedance. In some cases, a voltage-mode LDO regulator circuit may employ a technique referred to as "dynamic biasing," in which the output current is mirrored to generate a buffer current to drive the regulation device. The use of dynamic biasing is limited in cases when the voltage-mode LDO regulator circuit is in the dropout region and the load current is small, as the small load current limits the operation of the current mirror. Additionally, dynamic biasing may result in stability issues in a voltage-mode LDO regulator circuit.

To overcome the limitations associated with dynamic biasing, some voltage-mode LDO regulator circuits may employ more complicated sensing networks (e.g., a servo loop) to replace the aforementioned current mirror. In some cases, multiple control loops may be used to improve the transient response of a voltage-mode LDO regulator circuit, further increasing the complexity and area of the regulator circuit.

The inventors have realized that such solutions complicate circuit design and debug, and that by appropriately adjusting currents sourced to, and sunk from, the control terminal of the regulation device, the control voltage can quickly change to achieve regulation. As used herein, sourcing current to a circuit node refers to adding charge to the circuit node over a period of time, and sinking current from the circuit node refers to removing charge from the circuit node over a period of time. When the LDO regulator circuit is in a balanced state, i.e., when the voltage level of the regulated power supply node is substantially the same as the reference voltage level, circuits generating the source and sink currents can be biased to a low level reducing the quiescent current of the LDO regulator circuit to regulate its output voltage.

The embodiments illustrated in the drawings and described below provide techniques for operating an LDO regulator circuit that include sourcing and sinking currents to a control node of the regulator circuit, thereby reducing the quiescent current consumption of the regulator.

A block diagram depicting an embodiment of a voltage regulator circuit is illustrated in FIG. 1. As illustrated, voltage regulator circuit 100 includes control circuit 101 and device 102.

Device 102 includes at least one transconductance device (e.g., a transistor) and is coupled between input power supply node 103 and regulated power supply node 104. In various embodiments, device 102 is configured to change, using control node voltage level 109, supply current 111 that flows from input power supply node 103 to regulated power supply node 104. Device 102 may, in some embodiments, be implemented as either an n-channel or p-channel metal-oxide semiconductor field-effect transistor (MOSFET). In some cases, device 102 may include multiple MOSFETs coupled together in parallel. By allowing for the use of either n-channel or p-channel devices in device 102, the use lower voltage levels of input power supply node 103 may not impact the ability of voltage regulator circuit to keep device in saturation. The voltage range on a control terminal of a regulation device (e.g., device 102) necessary to keep the regulation device in saturation is commonly referred to as "headroom" and can be impacted by the type of the device as well as the voltage level of an input power supply.

Control circuit 101 is configured to generate feedback signal 113 using regulated power supply node voltage level 110, and compare a voltage level of feedback signal 113 to reference voltage level 105 to generate error signal 106. As described below, control circuit 101 may employ a voltage divider circuit to generate feedback signal 113. In some cases, a voltage level of feedback signal 113 may be scaled relative to the voltage level of regulated power supply node 104 to allow for different voltage levels on regulated power supply node 104 using a single reference voltage level. Control circuit 101 may employ a differential, or other suitable amplifier, to generate error signal 106 such that a voltage level of error signal 106 is proportional to a difference between reference voltage level 105 and the voltage level of feedback signal 206.

Control circuit 101 is further configured to adjust the voltage level of control node 108 using adjustment current 107, whose value is based on error signal 106 and control node voltage level 109. As described below, to adjust the voltage level of control node 108, control circuit 101 may be further configured to source current to control node 108 and sink current from control node 108. By adjusting the voltage level of the control node in this fashion, control circuit 101 may provide a high transient current (also referred to as "dynamic current") to control node 108. The use of a high dynamic current allows charge to be rapidly added or removed from control node 108, thereby causing a rapid change in the voltage level of control node 108. When the voltage of control node 108 can quickly change in response to changes in the voltage level of regulated power supply node 104, voltage regulator circuit 101 can respond to changes in the voltage level of regulated power supply node 104 due to changes in load current demand.

Figure 2:
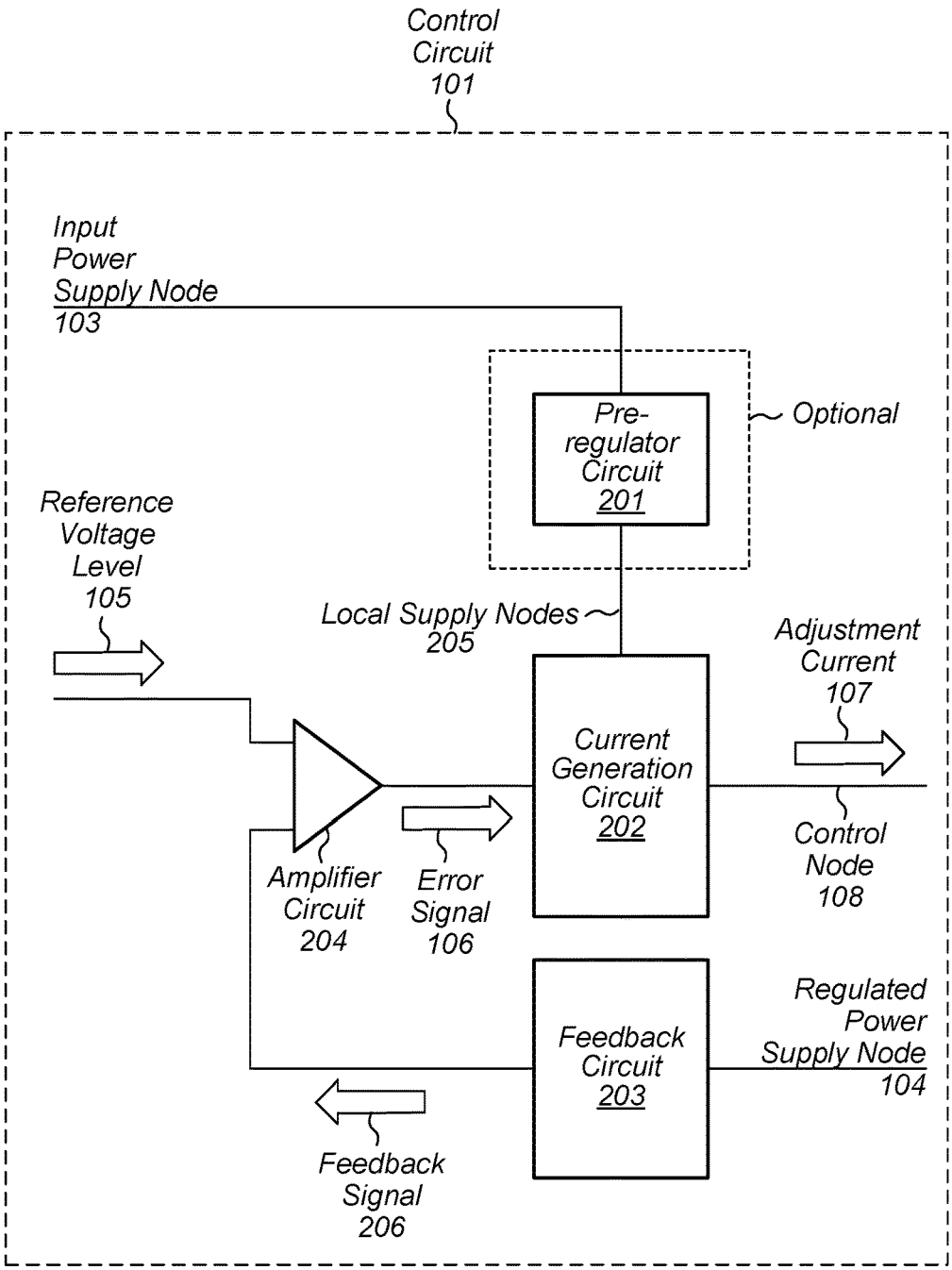
FIG. 2 is a block diagram of an embodiment of a control circuit for a voltage regulator circuit.

Turning to FIG. 2, a block diagram of an embodiment of control circuit 101 is depicted. As illustrated, control circuit 101 includes pre-regulator circuit 201, current generation circuit 202, feedback circuit 203, and amplifier circuit 204.

In cases where device 102 includes low-voltage metal-oxide semiconductor field-effect transistors (MOSFETs), a voltage level of input power supply node 103 may be large enough to damage the low-voltage MOSFETs. To prevent this from happening, an optional pre-regulator circuit may be employed. As illustrated, pre-regulator circuit 210 is configured to generate local supply nodes 205 using input power supply node 103. In some cases, local supply nodes 205 may include both a local power supply node and a local ground supply node. In various embodiments, pre-regulator circuit 210 may include a resistor, a diode, a diode-connected MOSFET, or any other suitable circuit configured to generate a voltage level on a given one of local supply nodes 205 that is less than a voltage level of input power supply node 103.

Current generation circuit 202 is configured to generate adjustment current 107 using error signals 106 and local supply nodes 205. In various embodiments, current generation circuit 202 may be configured to source adjustment current 107 to control node 108 (in which case, current generation circuit 202 is referred to as a "source driver"). Alternatively, current generation circuit 202 may be configured to sink adjustment current 107 from control node 108 (in which case, current generation circuit 202 is referred to as a "sink driver"). As described below, current generation circuit 202 may additionally use a voltage level of control node 108 to generate adjustment current 107.

Feedback circuit 203 is configured to generate feedback signal 206 using regulated power supply node 104. As described below, feedback circuit 203 may be configured to generate feedback signal 206 such that a voltage level of feedback signal 206 is a scaled version of a voltage level of regulated power supply node 104.

Amplifier circuit 204 (referred to as an "error amplifier") is configured to generate error signal 106 using feedback signal 206 and reference voltage level 105. In various embodiments, amplifier circuit 204 may be configured to generate error signals 106 such that a voltage level of error signal 106 is proportional to a difference between a voltage level of feedback signal 206 and reference voltage level 105. Amplifier circuit 204 may, in some embodiments, be implemented a single-stage operational amplifier circuit, a two-stage operational amplifier with a low-gain first stage, or any other suitable amplifier circuit.

As noted above, current generation circuit 202 may either be a source driver or a sink driver. Different circuit topologies may be employed for current generation circuit 202 based on whether it is a source driver or a sink driver. It is noted that in some cases, current generation circuit 202 may include both a source driver and a sink driver.

Figure 3:
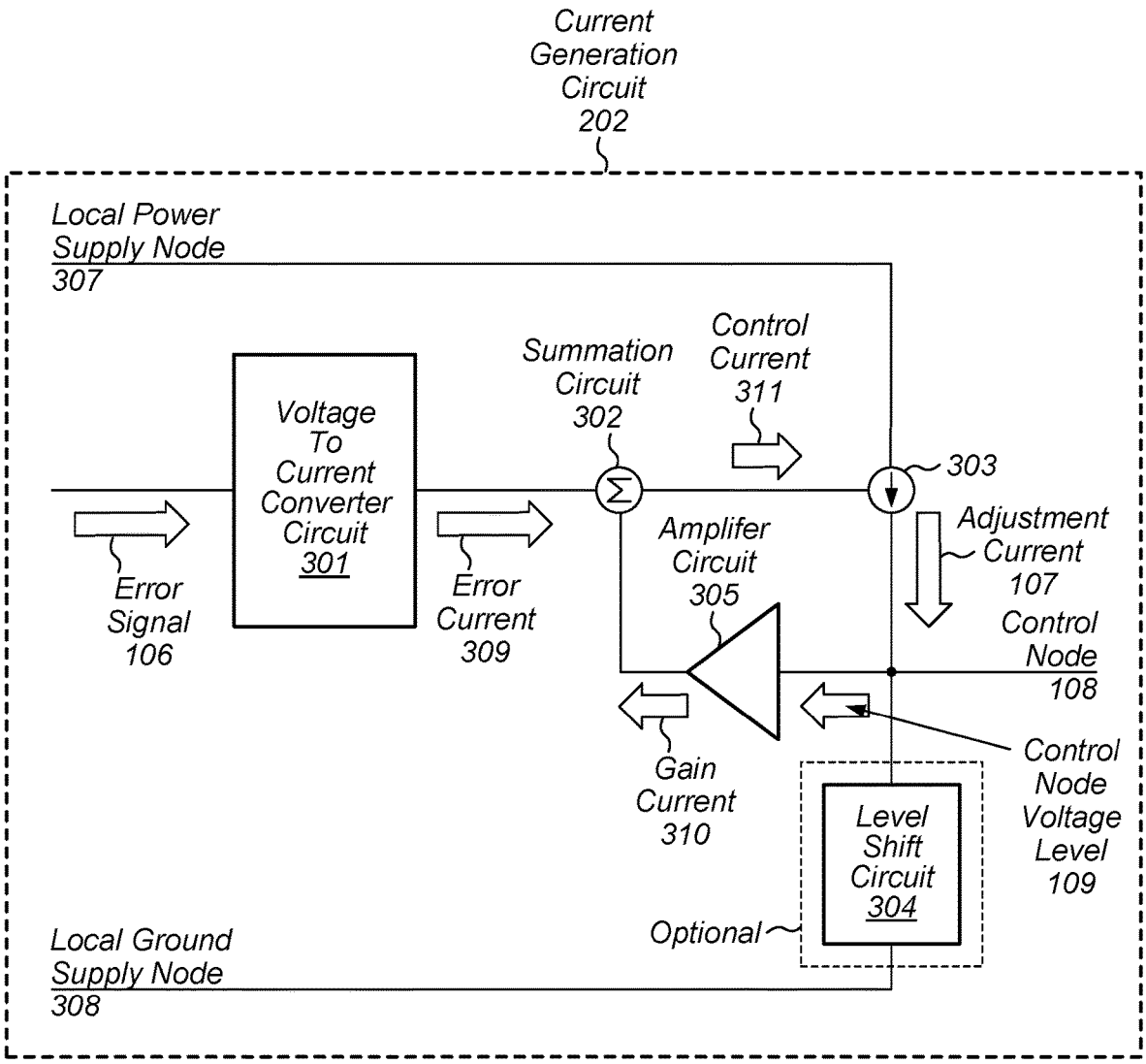
FIG. 3 is a block diagram of an embodiment of a current generation circuit for a voltage regulator circuit.

A block diagram of an embodiment of current generation circuit 202 that is configured to source adjustment current 107 to control node 108 is depicted in FIG. 3. As illustrated, current generation circuit 202 includes voltage-to-current converter circuit 301, summation circuit 302, current source 303, level shift circuit 304, and amplifier circuit 305.

Voltage-to-current converter circuit 301 is configured to generate error current 309 using error signal 106. In various embodiments, voltage-to-current converter circuit 301 may include a device (e.g., a p-channel or n-channel MOSFET) that is configured to generate a current based on a voltage level of error signal 106. Alternatively, voltage-to-current converter circuit 301 may include an operational amplifier or other suitable circuit configured to generate error current 309 based on the voltage level of error signal 106.

Summation circuit 302 is configured to generate control current 311 using error current 309 and gain current 310. In some cases, summation circuit 302 may be configured to add error current 309 and gain current 310 to generate control current 311. In various embodiments, summation circuit may include an amplifier or other suitable circuit configured to generate control current 311, whose value is proportional to a sum of error current 309 and gain current 310.

Current source 303 is coupled between local power supply node 307 and control node 108, and is configured to source adjustment current 107 to control node 108 using control current 311. In some cases, a value of adjustment current 107 may be based on a value of control current 311. Current source 303 may, in various embodiments, include one or more p-channel or n-channel MOSFETs that are biased, using control current 311, to source adjustment current 107 to control node 108.

Amplifier circuit 305 is coupled between control node 108 and summation circuit 302, and is configured to generate gain current 310 using control node voltage level 109. In various embodiments, amplifier circuit 305 may be implemented as a transconductance amplifier circuit configured to generate gain current 310 using control node voltage level 109 such that a value of gain current 310 is proportional to control node voltage level 109. It is noted that the circuit loop formed by amplifier circuit 305 and summation circuit 302 may reduce an impedance seen at a control terminal of device 102.

In cases where control circuit 101 includes both a source driver and a sink driver, the DC level between the source driver and the sink driver may be different. To prevent a short between the two driver circuits, level shift circuit 304 is included. Level shift circuit 304 is coupled between control node 108 and local ground supply node 308, and is configured to generate a DC voltage level on control node 108 using local ground supply node 308. In various embodiments, the generated DC voltage level may be greater than the voltage level of local ground supply node 308. Level shift circuit 304 may, in some embodiments, include a resistor, a diode, a diode-connected MOSFET, or any other suitable combination of circuit elements.

Figure 4:
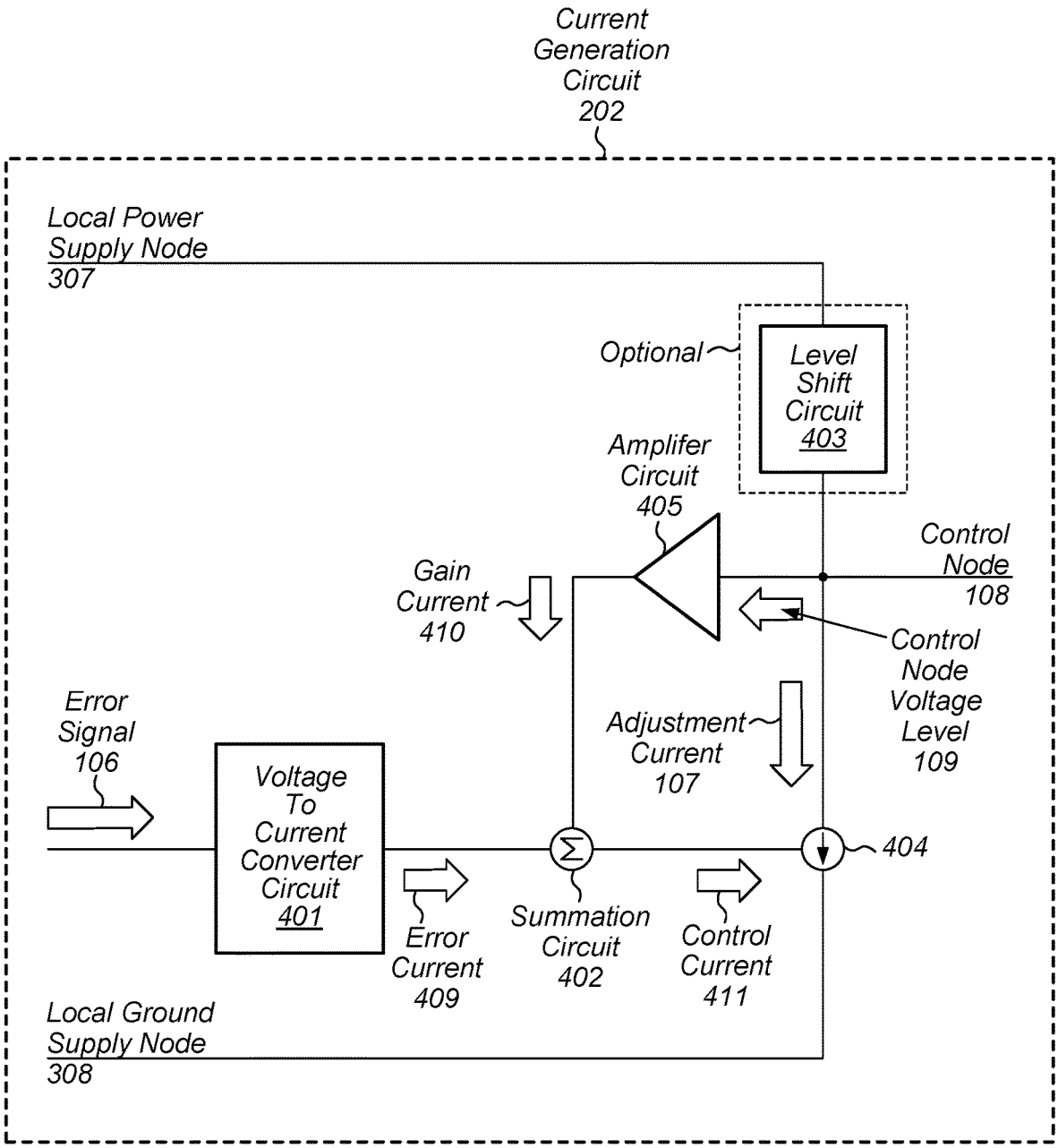
FIG. 4 is a block diagram of another embodiment of a current generation circuit for a voltage regulator circuit.

A block diagram of an embodiment of current generation circuit 202 that is configured to sink adjustment current 107 to control node 108 is depicted in FIG. 4. As illustrated, current generation circuit 202 includes voltage-to-current converter circuit 401, summation circuit 402, current source 404, level shift circuit 403, and amplifier circuit 405.

Voltage-to-current converter circuit 401 is configured to generate error current 409 using error signal 106. In various embodiments, voltage-to-current converter circuit 301 may include a device (e.g., a p-channel or n-channel MOSFET) that is configured to generate a current based on a voltage level of error signal 106. Alternatively, voltage-to-current converter circuit 401 may include an operational amplifier or other suitable circuit configured to generate error current 409 based on the voltage level of error signal 106.

Summation circuit 402 is configured to generate control current 411 using error current 409 and gain current 410. In some cases, summation circuit 402 may be configured to add error current 409 and gain current 410 to generate control current 411. In various embodiments, summation circuit may include an amplifier or other suitable circuit configured to generate control current 411 whose value is proportional to a sum of error current 409 and gain current 410.

Current source 404 is coupled between control node 108 and local ground supply node 308, and is configured to sink adjustment current 107 from control node 108 using control current 411. In some cases, a value of adjustment current 107 may be based on a value of control current 411. Current source 404 may, in various embodiments, include one or more n-channel MOSFETs that are biased, using control current 411, to sink adjustment current 107 from control node 108.

Amplifier circuit 405 is coupled between control node 108 and summation circuit 402, and is configured to generate gain current 410 using control node voltage level 109. In various embodiments, amplifier circuit 405 may be implemented as a transconductance amplifier circuit configured to generate gain current 410 using control node voltage level 109, such that a value of gain current 410 is proportional to control node voltage level 109. As with the embodiment of current generation circuit 202 depicted in FIG. 3, the circuit loop formed by amplifier circuit 405 and summation circuit 402 may reduce an impedance seen at a control terminal of device 102.

In cases where control circuit 101 includes both a source driver and a sink driver, the DC level between the source driver and the sink driver may be different. To prevent a short between the two driver circuits, level shift circuit 403 is included. Level shift circuit 403 is coupled between control node 108 and local power supply node 307, and is configured to generate a DC voltage level on control node 108 using local power supply node 307. In various embodiments, the generated DC voltage level may be less than the voltage level of local power supply node 307. Level shift circuit 403 may, in some embodiments, include a resistor, a diode, a diode-connected MOSFET, or any other suitable combination of circuit elements.

Figure 5:
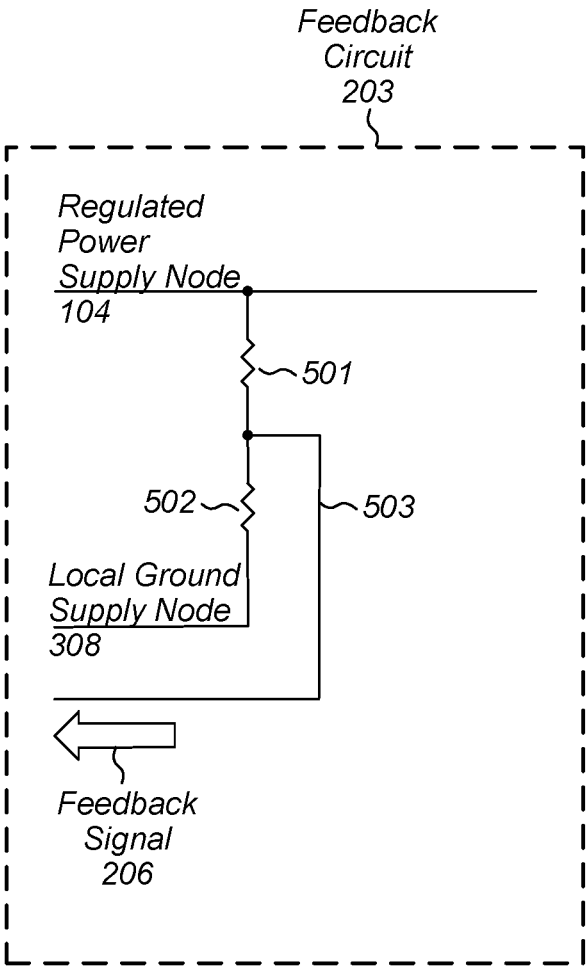
FIG. 5 is a block diagram of a feedback circuit for a voltage regulator circuit.

In some cases, it is desirable to scale the voltage level of regulated power supply node 104 prior to comparing it to reference voltage level 105. By using such scaling, different ranges of regulation may be possible. Such scaling may be accomplished using feedback circuit 203, an embodiment of which is depicted in FIG. 5. As illustrated, feedback circuit 203 includes resistors 501 and 502. Resistor 501 is coupled between regulated power supply node 104 and node 503, while resistor 502 is coupled between node 503 and local ground supply node 308.

When a voltage level of regulated power supply node 104 is greater than a voltage level of local ground supply node 308, a current will flow through from regulated power supply node 104 to local ground supply node 308. The value of the current may be based, at least in part, on respective resistance values of resistors 501 and 502.

As the current flows from regulated power supply node 104 to local ground supply node 308, a voltage develops across each of resistors 501 and 502, which results in a voltage level on node 503 corresponding to feedback signal 206. The values of the voltages across resistors 501 and 502 may be proportional to the value of the current flowing from regulated power supply node 104 to local ground supply node 308 multiplied by the respective values of resistors 501 and 502. By adjusting the values of resistors 501 and 502, the voltage level of feedback signal 206 may be adjusted. For example, if the values of resistors 501 and 502 are equal, then the voltage level of feedback signal 206 is half of the voltage level of regulated power supply node 104.

In various embodiments, resistors 501 and 502 may be implemented using polysilicon, metal, or any other suitable material available on a semiconductor manufacturing process. In some cases, resistors 501 and 502 may be located on a different integrated circuit chip than the rest of voltage regulator circuit 100. Although only two resistors are depicted, in other embodiments, more than two resistors may be employed, along with multiple switches, to allow the values of resistors 501 and 502 to be programmable.

Figure 6:
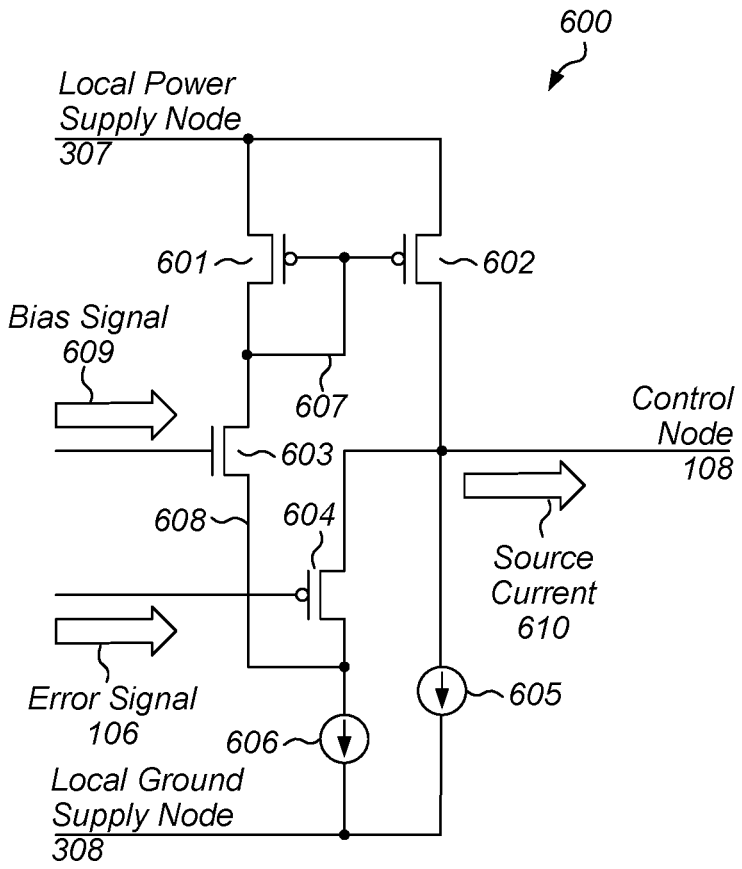
FIG. 6 is a schematic diagram of an embodiment of a source current generation circuit.

A device-level diagram of an embodiment for a source current circuit (or "source driver") is depicted in FIG. 6. As illustrated, source current circuit 600 includes devices 601-604, and current sources 605 and 606. It is noted that in various embodiments, source current circuit 600 may correspond to current generation circuit 202.

Device 601 is coupled between local power supply node 307 and node 607, while device 602 is coupled between local power supply node 307 and control node 108. Devices 601 and 602 are arranged as a current mirror such that a current flowing through device 601 is duplicated (or "mirrored") in device 602. In various embodiments, devices 601 and 602 may be embodiments of p-channel MOSFETs.

Device 603 is coupled between nodes 607 and 608, and is controlled by bias signal 609. A voltage level of bias signal 609 determines a current flowing through device 603, which, in turn, flows through device 601 and is then mirrored in device 602. In various embodiments, bias signal 609 may be generated using a reference circuit (e.g., bandgap reference circuit), current mirror circuits, and the like.

Device 604 is coupled between control node 108 and node 608, and is controlled by error signal 106. A current flowing through device 604 is determined, in part, by a voltage level of error signal 106. A value of source current 610 is based on a combination of the current flowing through device 602, the current flowing through device 604, and the current being sunk by current source 605.

In various embodiments, devices 601, 602 and 604 may be implemented as p-channel MOSFETs or any other suitable transconductance device. Device 603 may be implemented as an n-channel MOSFET or any other suitable transconductance device.

Current source 606 is coupled between node 608 and local ground supply node 308, while current source 605 is coupled between control node 108 and local ground supply node 308. Current source 606 contributes to the respective operating points of device 603 and 604. Since source current circuit 600 does not include a sink driver, current source 605 is included to help sink current from control node 108 to allow the voltage level of control node 108 to decrease when necessary. In some cases, current source 605 may be implemented as a voltage-controlled current source that is controlled by error signal 106. In various embodiments, currents sources 605 and 606 may include one or more n-channel MOSFETs configured to sink currents from node 608 and control node 108, respectively, using respective control signals.

Figure 7:
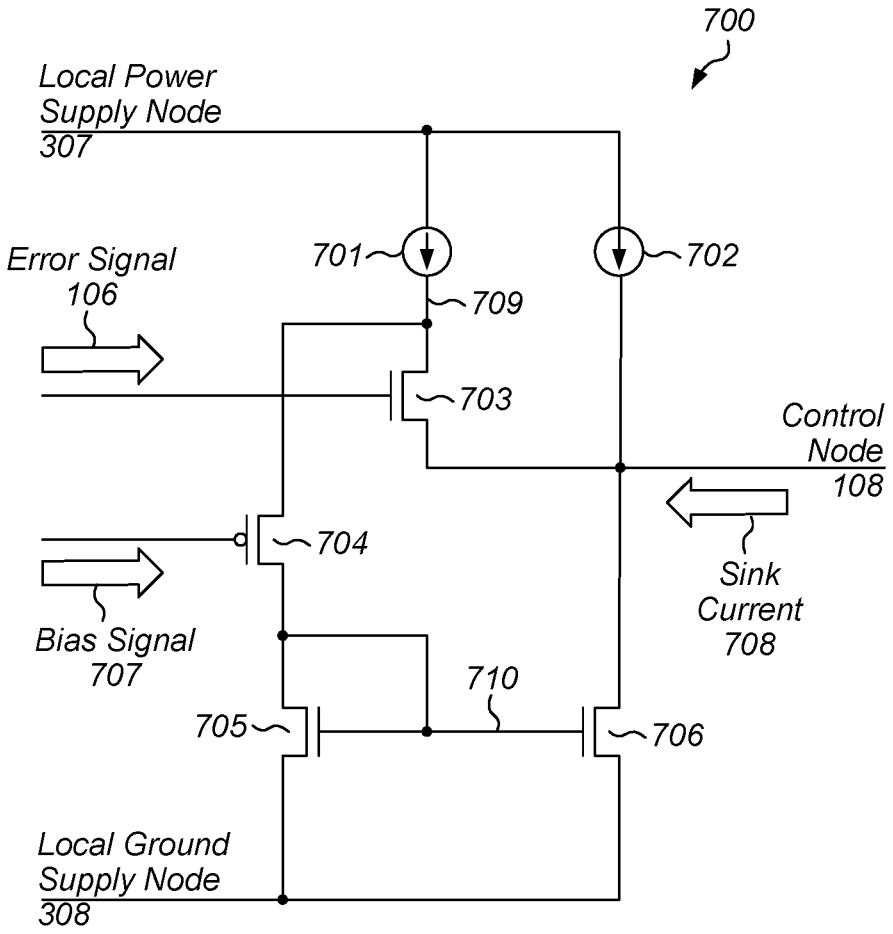
FIG. 7 is a schematic diagram of a sink current generation circuit.

A device-level diagram of an embodiment for a sink current circuit (or "sink driver") is depicted in FIG. 7. As illustrated, sink current circuit 700 includes devices 703-706, and current sources 701 and 702. It is noted that in various embodiments, sink current circuit 700 may correspond to current generation circuit 202.

Current source 701 is coupled between local power supply node 307 and node 709, while current source 702 is coupled between local power supply node 307 and control node 108. Current source 701 may contribute to biasing devices 703 and 704. Since sink current circuit 700 does not include a source driver, current source 702 is included to help source current to control node 108 to allow the voltage level of control node 108 to increase when necessary. In some cases, current source 702 may be implemented as a voltage-controlled current source that is controlled by error signal 106. In various embodiments, currents sources 701 and 702 may include one or more p-channel MOSFETs configured to source currents from node 709 and control node 108, respectively, using respective control signals.

Device 703 is coupled between control node 108 and node 709, and is controlled by error signal 106. A current flowing through device 703 is determined, in part, by a voltage level of error signal 106.

Device 704 is coupled between nodes 709 and 710, and is controlled by bias signal 707. A voltage level of bias signal 707 determines a current flowing through device 704, which, in turn, flows through device 705 and is then mirrored in device 706. In various embodiments, bias signal 707 may be generated using a reference circuit (e.g., bandgap reference circuit), current mirror circuits, and the like. A value of sink current 708 is based on a combination of the current flowing through device 706, the current flowing through device 703, and the current being source by current source 702.

Device 705 is coupled between node 710 and local ground supply node 308, while device 706 is coupled between local ground supply node 308 and control node 108. Devices 705 and 706 are arranged as a current mirror such that a current flowing through device 705 is duplicated (or "mirrored") in device 706. In various embodiments, devices 705 and 706 may be embodiments of n-channel MOSFETs.

In various embodiments, device 704 may be implemented as a p-channel MOSFET or any other suitable transconductance device. Devices 703, 705, and 706 may be embodiments of n-channel MOSFETs or any other suitable transconductance device.

Figure 8:
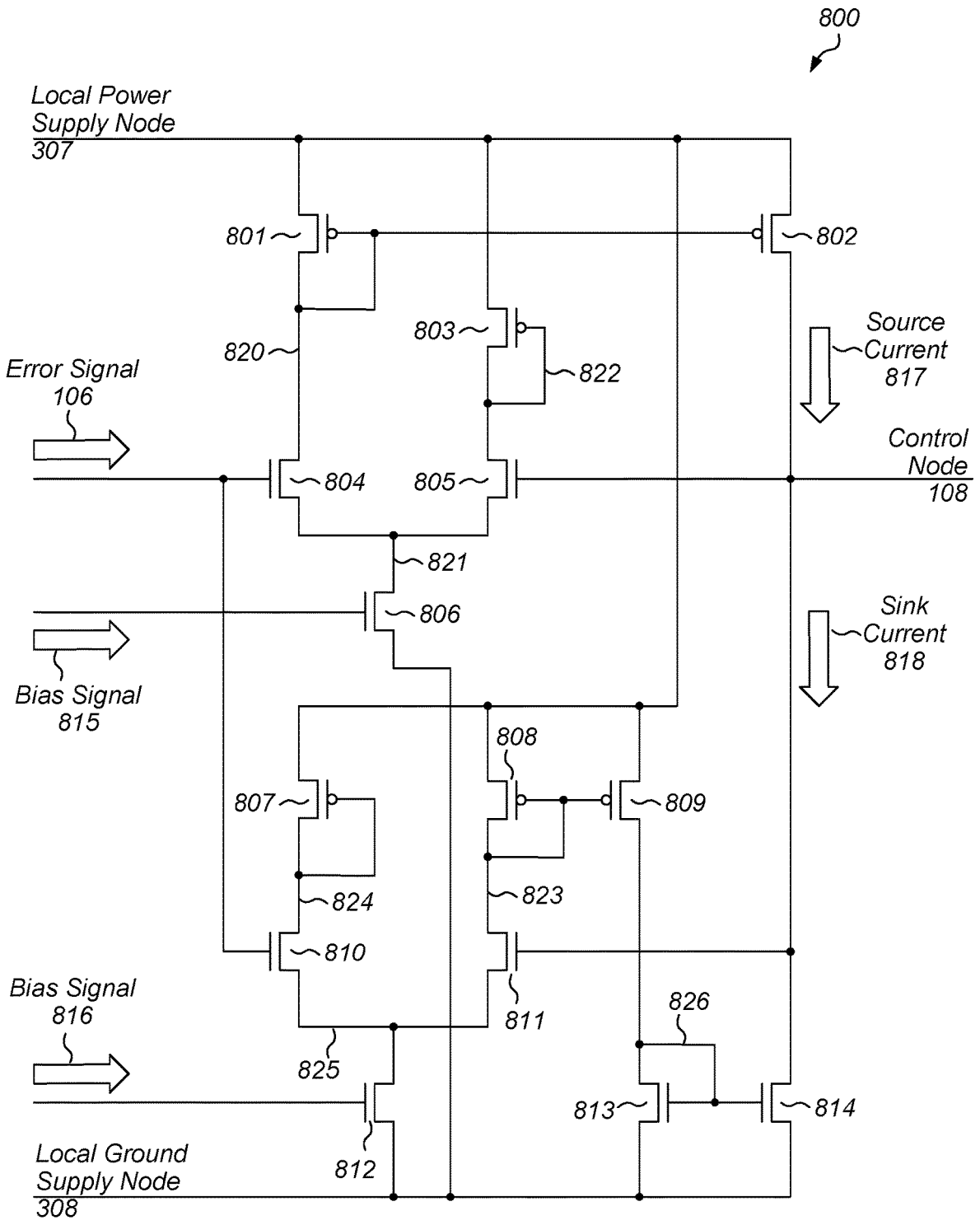
FIG. 8 is a schematic diagram of an embodiment of a source/sink current generation circuit.

A device-level diagram of an embodiment of a current generation circuit is depicted in FIG. 8. As illustrated, current generation circuit 800 includes both a sink and source driver, and includes devices 801-814. It is noted that in various embodiments, current generation circuit 800 may correspond to current generation circuit 202.

Device 801 is coupled between local power supply node 307 and node 820, and device 802 is coupled between local power supply node 307 and control node 108. Respective control terminals of devices 801 and 802 are coupled to node 820. Devices 801 and 802 are arranged as a current mirror such that a current flowing through device 801 is duplicated (or "mirrored") in device 802. In various embodiments, the current flowing through device 802 is source current 816.

Device 803 is coupled between local power supply node 307 and node 822. A control terminal of device 803 is also coupled to node 822. Device 804 is coupled between node 820 and node 821 and is controlled by error signal 106, while device 805 is coupled between node 822 and node 821 and is controlled by a voltage level of control node 108. In various embodiments, devices 804 and 805 form a differential pair configured to amplify a difference between the voltage levels of error signal 106 and control node 108. Device 806 is coupled between node 821 and local ground supply node 308, and controlled by bias signal 815. Device 806 is configured to generate a bias current for the differential pair formed by devices 804 and 805 using bias signal 815. In various embodiments, a reference circuit that may include a bandgap reference circuit, a current mirror circuit, and the like generates bias signal 815.

Device 808 is coupled between local power supply node 307 and node 823, while device 809 is coupled between local power supply node 307 and node 826. Respective control terminals of devices 808 and 809 are coupled to node 823. Devices 808 and 809 are arranged as a current mirror such that a current flowing through device 808 is duplicated (or "mirrored") in device 809.

Device 807 is coupled between local power supply node 307 and node 824. A control terminal of device 807 is coupled to node 824. Device 810 is coupled between node 824 and node 825, and is controlled by error signal 106. Device 811 is coupled between node 823 and node 825. A control terminal of device 811 is coupled to control node 108. In various embodiments, devices 810 and 811 form a differential pair configured to amplify a difference in the voltage levels of error signal 106 and control node 108. Device 812 is coupled between node 825 and local ground supply node 308, and is controlled by bias signal 815. Device 812 is configured to generate a bias current for the differential pair formed by devices 810 and 811 using bias signal 815. In various embodiments, a reference circuit that may include a bandgap reference circuit, a current mirror circuit, and the like generates bias signal 815.

Device 813 is coupled between node 826 and local ground supply node 308, and device 814 is coupled between control node 108 and local ground supply node 308. Respective control terminals of devices 813 and 814 are coupled to node 826. Devices 813 and 814 are arranged as a current mirror such that a current flowing through device 813 is duplicated (or "mirrored") in device 814. In various embodiments, the current flowing through device 814 is sink current 818.

In various embodiments, devices 801-803, 807-809 may be embodiments of p-channel MOSFETs or any other suitable transconductance device. Devices 804-806, and 810-814 may be embodiments of n-channel MOSFETs or any other suitable transconductance device.

Figure 9:
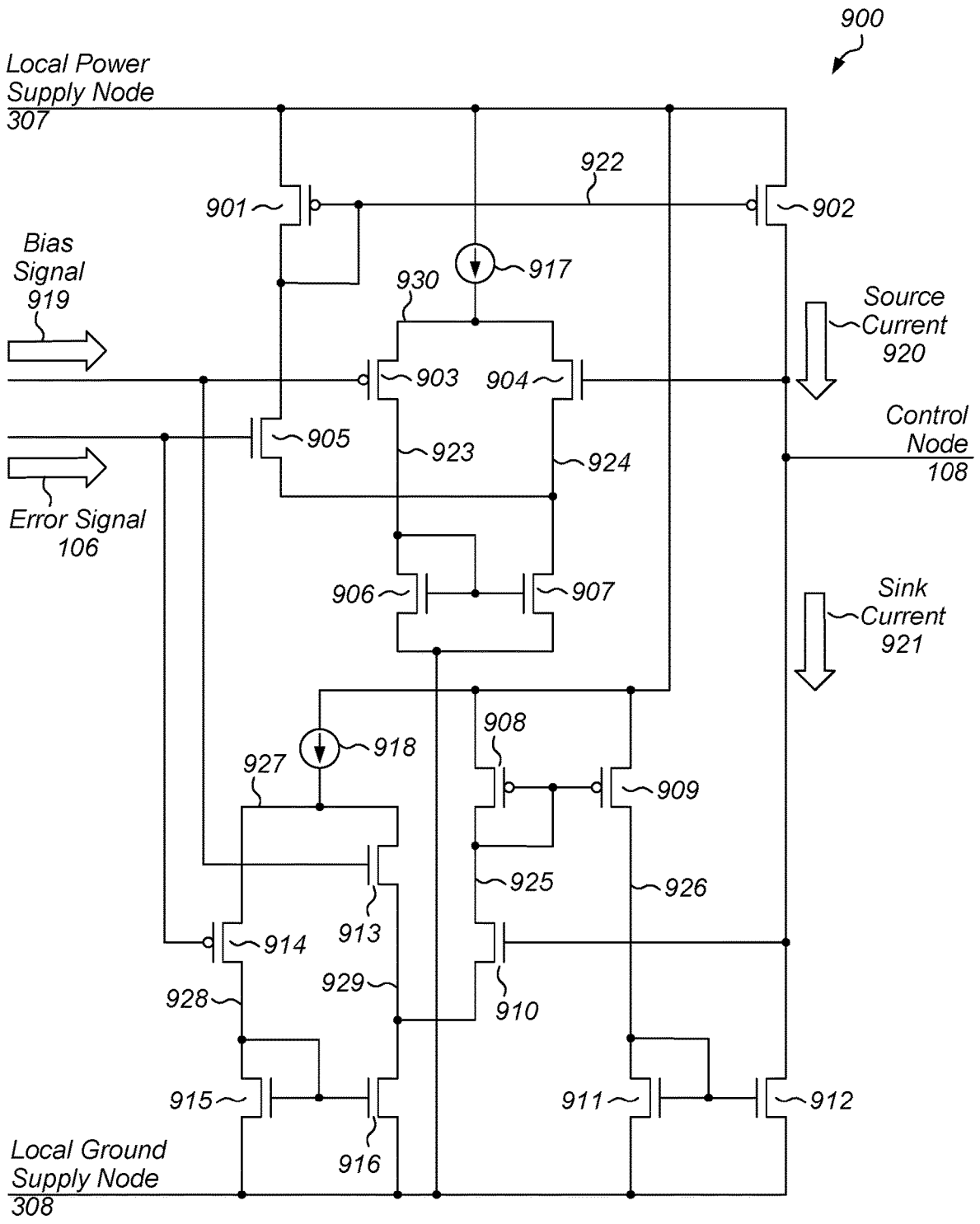
FIG. 9 is a schematic diagram of another embodiment of a source/sink current generation circuit.

A device-level diagram of another embodiment of a current generation circuit is depicted in FIG. 9. As illustrated, current generation circuit 900 includes both a sink and source driver, and includes devices 901-916, and current sources 917 and 918. It is noted that in various embodiments, current generation circuit 900 may correspond to current generation circuit 202.

Device 901 is coupled between local power supply node 307 and node 922, and device 902 is coupled between local power supply node 307 and control node 108. Respective control terminals of devices 901 and 902 are coupled to node 922. Devices 901 and 902 are arranged as a current mirror such that a current flowing through device 901 is duplicated (or "mirrored") in device 902. In various embodiments, the current flowing through device 902 is source current 920.

Current source 917 is coupled between local power supply node 307 and node 930, and is configured to provide a bias current for devices 903 and 904. In various embodiments, current source 917 may include one or more MOSFETs or any other suitable circuit elements.

Device 903 is coupled between node 930, and is controlled by bias signal 919. Device 904 is coupled between node 930 and node 924, and is controlled by a voltage level of control node 108. In various embodiments, a reference circuit that may include a bandgap reference circuit, a current mirror circuit, and the like, may generate bias signal 919.

Device 905 is coupled between node 922 and node 924, and is controlled by error signal 9191. Device 906 is coupled between node 923 and local ground supply node 308, while device 907 is coupled between node 924 and local ground supply node 308. Respective control terminals of devices 906 and 907 are coupled to node 923. Devices 906 and 907 are arranged as a current mirror such that a current flowing through device 906 is duplicated (or "mirrored") in device 907.

Current source 918 is coupled between local power supply node 307 and node 927, and is configured to provide a bias current to devices 914 and 913. In various embodiments, current source 917 may include one or more MOSFETs or any other suitable circuit elements.

Device 913 is coupled between node 927 and node 929, and is controlled by bias signal 919. Device 914 is coupled between node 927 and node 928, and is controlled by error signal 106. Device 915 is coupled between node 928 and local ground supply node 308, while device 916 is coupled between node 929 and local ground supply node 308. Respective control terminals of devices 915 and 916 are coupled to node 928. Devices 915 and 916 are arranged as a current mirror such that a current flowing through device 915 is duplicated (or "mirrored") in device 916.

Device 908 is coupled between local power supply node 307 and node 925, while device 909 is coupled between local power supply node 307 and node 926. Respective control terminals of devices 908 and 909 are coupled to node 925. Devices 908 and 909 are arranged as a current mirror such that a current flowing through device 908 is duplicated (or "mirrored") in device 909.

Device 910 is coupled between node 925 and node 929, and is controlled by the voltage level of control node 108. Device 911 is coupled between node 926 and local ground supply node 308, while device 912 is coupled between control node 108 and local ground supply node 308. Respective control terminals of devices 911 and 912 are coupled to node 926. Devices 911 and 912 are arranged as a current mirror such that a current flowing through device 911 is duplicated (or "mirrored") in device 912. In various embodiments, the current flowing through device 912 is sink current 921.

In various embodiments, devices 901-903, 908, 909, and 914 may be embodiments of p-channel MOSFETs or any other suitable transconductance device. Devices 904-907, 910-913, 915, and 916 may be embodiments of n-channel MOSFETs or any other suitable transconductance device.

Figure 10:
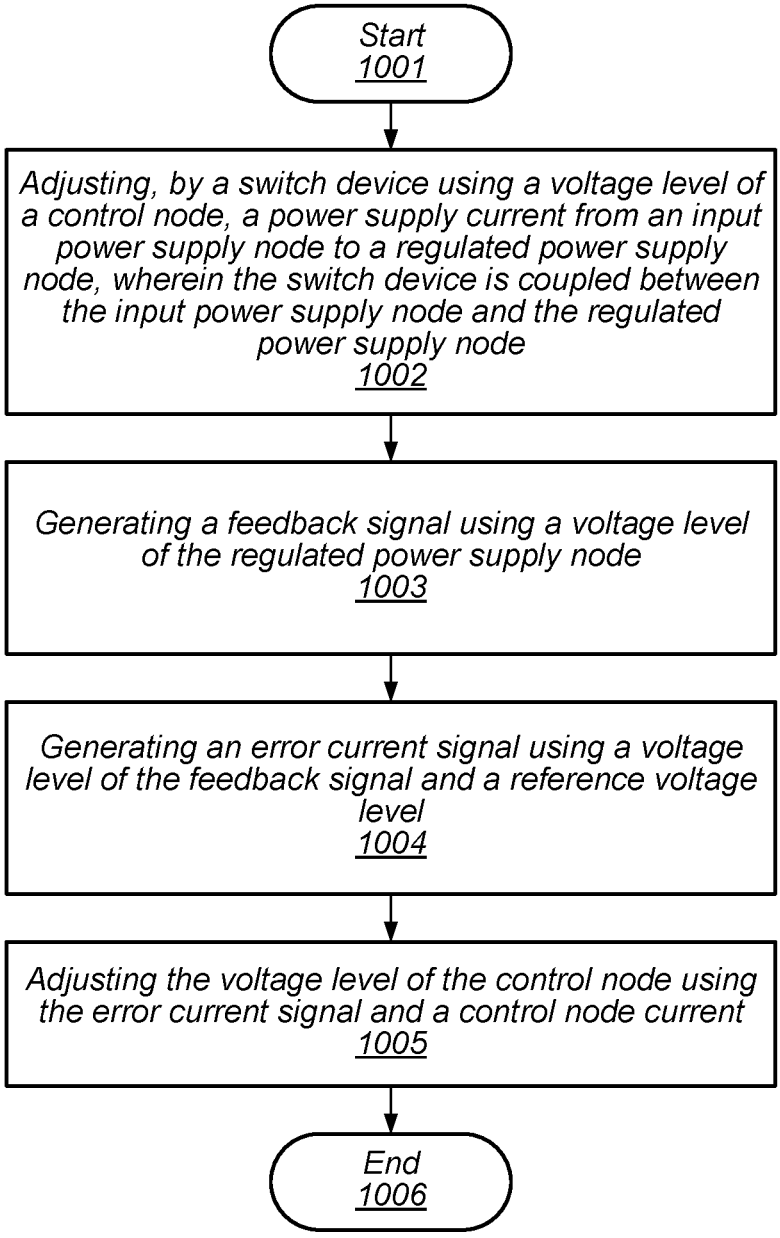
FIG. 10 depicts a flow diagram illustrating an embodiment of a method for operating a voltage regulator circuit.

Turning to FIG. 10, a flow diagram depicting an embodiment of a method for operating a voltage regulator circuit is illustrated. The method, which begins in block 1001, may be applied to various voltage regulator circuits, such as voltage regulator circuit 100 as illustrated in FIG. 1.

The method includes adjusting, by a switch device using a voltage level of a control node, a power supply current from an input power supply node to a regulated power supply node, wherein the switch device is coupled between the input power supply node and the regulated power supply node (block 1002). The method further includes generating a feedback signal using a voltage level of the regulated power supply node (block 1003).

The method also includes generating an error current signal using a voltage level of the feedback signal and a reference voltage level (block 1004). In various embodiments, generating the error current signal may include generating a particular voltage level based, at least in part, on a difference between the voltage level of the feedback signal and the reference voltage level, and converting the particular voltage level to error current signal.

The method further includes adjusting the voltage level of the control node using the error current signal and a control node current (block 1005). In some embodiments, adjusting the voltage level of the control node may include generating an adjustment current by summing the error current signal and a feedback current whose value is based, at least in part, on the control node current.

In some cases, the method may include sourcing the adjustment current to the control node, while, in other cases, the method may include sinking the adjustment current from the control node.

The method may, in some embodiments, include generating a first adjustment current by summing the error current single and a first feedback current whose value is based, at least in part, on a current being sunk from the control node, and sinking the first adjustment current from the control node. The method may also include generating a second adjust current by summing the error current signal and a second feedback current whose value is based, at least in part, on a current being sourced to the control node, and sourcing the second adjustment current to the control node.

In various embodiments, the method may further include generating a local power supply signal using the voltage level of the input power supply node and the voltage level of the regulated supply node, and generating the error current signal using the voltage level of the feedback signal and the local power supply signal. In such embodiments, the method may also include adjusting the voltage level of the control node using the error signal, the control node current, and the local power supply signal. The method concludes in block 1006.

Figure 11:
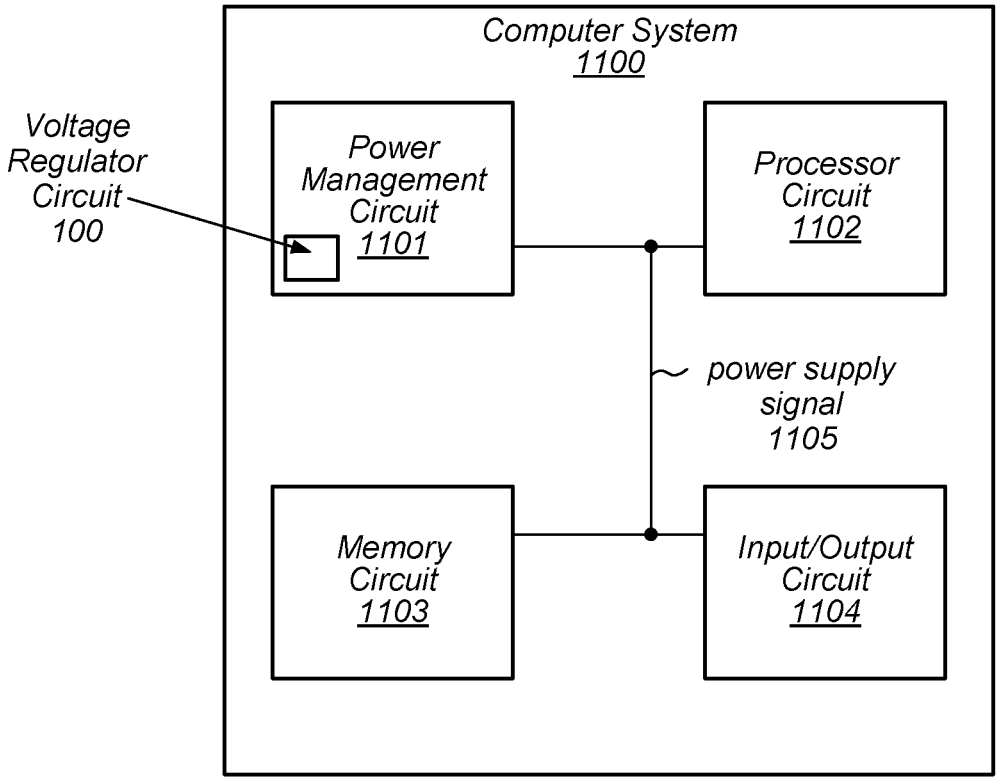
FIG. 11 illustrates a block diagram of a computer system.

A block diagram of computer system is illustrated in FIG. 11. In the illustrated embodiment, the computer system 1100 includes power management unit 1101, processor circuit 1102, memory circuit 1103, and input/output circuits 1104, each of which is coupled to power supply signal 1105. In various embodiments, computer system 1100 may be a system-on-a-chip (SoC) and/or be configured for use in a desktop computer, server, or in a mobile computing application such as, e.g., a tablet, laptop computer, or wearable computing device.

Power management unit 1101 includes voltage regulator circuit 100, which is configured to generate a regulated voltage level on power supply signal 1105 in order to provide power to processor circuit 1102, memory circuit 1103, and input/output circuits 1104. Although power management unit 1101 is depicted as including a single power converter circuit, in other embodiments, any suitable number of voltage regulator circuits may be included in power management unit 1101, each configured to generate a regulated voltage level on a respective one of multiple internal power supply signals included in computer system 1100. In cases where multiple voltage regulator circuits are employed, two or more of the multiple voltage regulator circuits may be connected to a common set of power terminals that connects to power supply signals and ground supply signals of computer system 1100.

Processor circuit 1102 may, in various embodiments, be representative of a general-purpose processor that performs computational operations. For example, processor circuit 1102 may be a central processing unit (CPU) such as a microprocessor, a microcontroller, an application-specific integrated circuit (ASIC), or a field-programmable gate array (FPGA).

Memory circuit 1103 may in various embodiments, include any suitable type of memory such as a Dynamic Random-Access Memory (DRAM), a Static Random-Access Memory (SRAM), a Read-Only Memory (ROM), Electrically Erasable Programmable Read-only Memory (EEPROM), or a non-volatile memory, for example. It is noted that although in a single memory circuit is illustrated in FIG. 11, in other embodiments, any suitable number of memory circuits may be employed.

Input/output circuits 1104 may be configured to coordinate data transfer between computer system 1100 and one or more peripheral devices. Such peripheral devices may include, without limitation, storage devices (e.g., magnetic or optical media-based storage devices including hard drives, tape drives, CD drives, DVD drives, etc.), audio processing subsystems, or any other suitable type of peripheral devices. In some embodiments, input/output circuits 1104 may be configured to implement a version of Universal Serial Bus (USB) protocol or IEEE 1394 (Firewire®) protocol.

Input/output circuits 1104 may also be configured to coordinate data transfer between computer system 1100 and one or more devices (e.g., other computing systems or integrated circuits) coupled to computer system 1100 via a network. In one embodiment, input/output circuits 1104 may be configured to perform the data processing necessary to implement an Ethernet (IEEE 802.3) networking standard such as Gigabit Ethernet or 10-Gigabit Ethernet, for example, although it is contemplated that any suitable networking standard may be implemented. In some embodiments, input/output circuits 1104 may be configured to implement multiple discrete network interface ports.

The present disclosure includes references to "embodiments," which are non-limiting implementations of the disclosed concepts. References to "an embodiment," "one embodiment," "a particular embodiment," "some embodiments," "various embodiments," and the like do not necessarily refer to the same embodiment. A large number of possible embodiments are contemplated, including specific embodiments described in detail, as well as modifications or alternatives that fall within the spirit or scope of the disclosure. Not all embodiments will necessarily manifest any or all of the potential advantages described herein.

Unless stated otherwise, the specific embodiments are not intended to limit the scope of claims that are drafted based on this disclosure to the disclosed forms, even where only a single example is described with respect to a particular feature. The disclosed embodiments are thus intended to be illustrative rather than restrictive, absent any statements to the contrary. The application is intended to cover such alternatives, modifications, and equivalents that would be apparent to a person skilled in the art having the benefit of this disclosure.

Particular features, structures, or characteristics may be combined in any suitable manner consistent with this disclosure. The disclosure is thus intended to include any feature or combination of features disclosed herein (either explicitly or implicitly), or any generalization thereof. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

For example, while the appended dependent claims are drafted such that each depends on a single other claim, additional dependencies are also contemplated. Where appropriate, it is also contemplated that claims drafted in one statutory type (e.g., apparatus) suggest corresponding claims of another statutory type (e.g., method).

Because this disclosure is a legal document, various terms and phrases may be subject to administrative and judicial interpretation. Public notice is hereby given that the following paragraphs, as well as definitions provided throughout the disclosure, are to be used in determining how to interpret claims that are drafted based on this disclosure.

Because this disclosure is a legal document, various terms and phrases may be subject to administrative and judicial interpretation. Public notice is hereby given that the following paragraphs, as well as definitions provided throughout the disclosure, are to be used in determining how to interpret claims that are drafted based on this disclosure.

References to the singular forms such as "a," "an," and "the" are intended to mean "one or more" unless the context clearly dictates otherwise. Reference to "an item" in a claim thus does not preclude additional instances of the item.

The word "may" is used herein in a permissive sense (i.e., having the potential to, being able to) and not in a mandatory sense (i.e., must).

The terms "comprising" and "including," and forms thereof, are open-ended and mean "including, but not limited to."

When the term "or" is used in this disclosure with respect to a list of options, it will generally be understood to be used in the inclusive sense unless the context provides otherwise. Thus, a recitation of "x or y" is equivalent to "x or y, or both," covering x but not y, y but not x, and both x and y. On the other hand, a phrase such as "either x or y, but not both" makes clear that "or" is being used in the exclusive sense.

A recitation of "w, x, y, or z, or any combination thereof" or "at least one of . . . w, x, y, and z" is intended to cover all possibilities involving a single element up to the total number of elements in the set. For example, given the set [w, x, y, z], these phrasings cover any single element of the set (e.g., w but not x, y, or z), any two elements (e.g., w and x, but not y or z), any three elements (e.g., w, x, and y, but not z), and all four elements. The phrase "at least one of . . . w, x, y, and z" thus refers to at least one of element of the set [w, x, y, z], thereby covering all possible combinations in this list of elements. This phrase is not to be interpreted to require that there is at least one instance of w, at least one instance of x, at least one instance of y, and at least one instance of z.

Various "labels" may proceed nouns in this disclosure. Unless context provides otherwise, different labels used for a feature (e.g., "first circuit," "second circuit," "particular circuit," "given circuit," etc.) refer to different instances of the feature. The labels "first," "second," and "third" when applied to a particular feature do not imply any type of ordering (e.g., spatial, temporal, logical, etc.), unless stated otherwise.

Within this disclosure, different entities (which may variously be referred to as "units," "circuits," other components, etc.) may be described or claimed as "configured" to perform one or more tasks or operations. This formulation—[entity] configured to [perform one or more tasks]—is used herein to refer to structure (i.e., something physical). More specifically, this formulation is used to indicate that this structure is arranged to perform the one or more tasks during operation. A structure can be said to be "configured to" perform some task even if the structure is not currently being operated. Thus, an entity described or recited as "configured to" perform some task refers to something physical, such as a device, circuit, memory storing program instructions executable to implement the task, etc. This phrase is not used herein to refer to something intangible.

The term "configured to" is not intended to mean "configurable to." An unprogrammed. FPGA, for example, would not be considered to be "configured to" perform some specific function. This unprogrammed FPGA may be "configurable to" perform that function, however.

Reciting in the appended claims that a structure is "configured to" perform one or more tasks is expressly intended not to invoke 35 U.S.C. § 112(f) for that claim element. Should Applicant wish to invoke Section 112(f) during prosecution, it will recite claim elements using the "means for" [performing a function] construct.

The phrase "based on" is used to describe one or more factors that affect a determination. This term does not foreclose the possibility that additional factors may affect the determination. That is, a determination may be solely based on specified factors or based on the specified factors as well as other, unspecified factors. Consider the phrase "determine A based on B." This phrase specifies that B is a factor that is used to determine A or that affects the determination of A. This phrase does not foreclose that the determination of A may also be based on some other factor, such as C. This phrase is also intended to cover an embodiment in which A is determined based solely on B. As used herein, the phrase "based on" is synonymous with the phrase "based at least in part on."

The phrase "in response to" describes one or more factors that trigger an effect. This phrase does not foreclose the possibility that additional factors may affect or otherwise trigger the effect. That is, an effect may be solely in response to those factors, or may be in response to the specified factors as well as other, unspecified factors. Consider the phrase "perform A in response to B." This phrase specifies that B is a factor that triggers the performance of A. This phrase does not foreclose that performing A may also be in response to some other factor, such as C. This phrase is also intended to cover an embodiment in which A is performed solely in response to B.

What is claimed is:

1. An apparatus, comprising:

a switch device coupled between an input power supply node and a regulated power supply node, wherein the switch device is configured to change, using a voltage level of a control node, a value of a supply current flowing from the input power supply node to the regulated power supply node; and a control circuit configured to:

generate a feedback signal using a voltage level of the regulated power supply node;

compare a voltage level of the feedback signal to a reference voltage level to generate an error signal;

sink, from the control node, a first current included in an adjustment current to adjust the voltage level of the control node, wherein a value of the adjustment current is based on the error signal and the voltage level of the control node; and source, to the control node, a second current included in the adjustment current to further adjust the voltage level of the control node.

2. The apparatus of claim 1, wherein the control circuit includes a pre-regulator circuit configured to generate a reduced voltage level on a local supply node, wherein the reduced voltage level is less than a voltage level of the input power supply node.

3. The apparatus of claim 2, wherein the control circuit is further configured to generate the first current and the second current using the reduced voltage level on the local supply node.

4. The apparatus of claim 1, wherein the control circuit includes a level-shift circuit coupled between the control node and a ground supply node and is configured to adjust the voltage level of the control node based on a voltage level of the ground supply node.

5. The apparatus of claim 1, wherein the control circuit is further configured to generate the error signal using a current whose value is based on a difference between the voltage level of the feedback signal and the reference voltage level.

6. The apparatus of claim 1, wherein the control circuit further includes a voltage divider circuit coupled to the regulated power supply node, wherein the voltage divider circuit is configured to generate the feedback signal using the voltage level of the regulated power supply node.

7. A method, comprising:

adjusting, by a switch device using a voltage level of a control node, a power supply current from an input power supply node to a regulated power supply node, wherein the switch device is coupled between the input power supply node and the regulated power supply node;

generating a feedback signal using a voltage level of the regulated power supply node;

generating an error signal using a voltage level of the feedback signal and a reference voltage level;

generating a first adjustment current by summing the error signal and a first feedback current whose value is based on a first current being sunk from the control node;

sinking the first adjustment current from the control node;

generating a second adjustment current by summing the error signal and a second feedback current whose value is based on a second current being sourced to the control node; and sourcing the second adjustment current to the control node.

8. The method of claim 7, further comprising generating a reduced voltage level on a local supply node, wherein the reduced voltage level is less than a voltage level of the input power supply node.

9. The method of claim 8, further comprising generating the first adjustment current and the second adjustment current using the reduced voltage level on the local supply node.

10. The method of claim 8, further comprising adjusting, by a level-shift circuit and based on a voltage level of a ground supply node, the voltage level of the control node.

11. The method of claim 7, wherein generating the error signal includes:

generating the error signal using a current whose value is based on a difference between the voltage level of the feedback signal and the reference voltage level.

12. The method of claim 7, further comprising:

generating a local power supply signal using the voltage level of the input power supply node and the voltage level of the regulated power supply node; and generating the error signal using the voltage level of the feedback signal, the reference voltage level, and the local power supply signal.

13. An apparatus, comprising:

a load circuit; and a voltage regulator circuit coupled to the load circuit via a regulated power supply node, wherein the voltage regulator circuit is configured to:

adjust, using a control signal, a power supply current sourced to the load circuit from an input power supply node via the regulated power supply node;

generate a feedback signal using a voltage level of the regulated power supply node;

generate an error signal using the voltage level of the feedback signal and a reference voltage level; and adjust a value of the control signal using the error signal and a control feedback signal whose value is indicative of a current associated with the control signal;

sense a value of the current associated with the control signal; and generate a mirrored version of the current associated with the control signal using the value of the current associated with the control signal to generate the control feedback signal.

14. The apparatus of claim 13, wherein to adjust the control signal, the voltage regulator circuit is further configured to increase the current associated with the control signal.

15. The apparatus of claim 13, wherein to adjust the control signal, the voltage regulator circuit is further configured to decrease the current associated with the control signal.

16. The apparatus of claim 13, wherein to adjust the control signal, the voltage regulator circuit is further configured to:

decrease, by a first amount, the current associated with the control signal; and increase, by a second amount, the current associated with the control signal.

17. The apparatus of claim 13, wherein the voltage regulator circuit includes a switch device coupled between the input power supply node and the regulated power supply node, wherein the switch device is configured to adjust an impedance between the input power supply node and the regulated power supply node using the control signal.

18. The apparatus of claim 13, wherein the voltage regulator circuit includes a voltage divider circuit coupled to the regulated power supply node, wherein the voltage divider circuit is configured to generate the feedback signal using the voltage level of the regulated power supply node.

* * * * *